United States Patent [19]

Wolens

[11] Patent Number: 5,060,398

[45] Date of Patent: Oct. 29, 1991

[54] AIR DIFFUSER

[76] Inventor: John Wolens, 40 Hazel Ave., Glencoe, Ill. 60022

[21] Appl. No.: 517,727

[22] Filed: May 2, 1990

[51] Int. Cl.[5] ..... F26B 19/00

[52] U.S. Cl. ..... 34/90; 34/97; 132/271

[58] Field of Search ..... 34/97, 99, 90; 239/587, 239/588, 554, 555, 558; 132/271, 116, 112; 219/380, 383, 384, 385

[56] References Cited

U.S. PATENT DOCUMENTS 761,451 5/1904 Cuvelier ..... 34/97 X 3,782,002 1/1974 Morane ..... 34/99

*Primary Examiner*—Henry A. Bennet

*Attorney, Agent, or Firm*—Niro, Scavone, Haller & Niro

[57] ABSTRACT

An air diffuser includes a base member having a collar for mounting the diffuser to the discharge port of a hand-held hair dryer and an air diffusing member. The base member and air diffusing members are slidably and telescopically engaged to permit extension to an operating position or retraction to a collapsed position.

4 Claims, 2 Drawing Sheets

AIR DIFFUSER

BACKGROUND OF THE INVENTION

The present invention relates to an air diffuser for use with a hand-held hair drying apparatus. More particularly, the present invention is directed to an improved air diffuser which is constructed from a plurality of a telescopically arranged members, permitting the diffuser to be extended for use and collapsed for storage or shipping.

It is well known in the personal care industry that a wide variety of air diffusing devices may be employed with a conventional hand-held hair dryer to improve the drying characteristics of the apparatus or to enhance various hair styling methods. However, the air diffusing devices presently in the market suffer from the disadvantage that they are relatively large and cumbersome, making it difficult to conveniently store the diffuser when not in use. In addition, the size of the prior art diffusers significantly increases the cost of packaging, shipping and display, thereby increasing the cost of the product to the consumer.

Accordingly, there is a need for an air diffuser for use with a hand-held hair drying apparatus which accommodates the size requirements necessary for proper hair drying uses but nevertheless is collapsible to minimize the space needed for storage and to reduce the costs of packaging, shipping and display.

SUMMARY OF INVENTION

The present invention is, therefore, directed to a new and improved air diffuser which may be conveniently used with any one of a variety of conventional hand-held hair dryers and which is collapsible.

The air diffuser of the present invention includes a base member having means for mounting the diffuser to the discharge port of a hand-held hair drying apparatus and an air diffusing member which includes an air discharge end provided with a plurality of air passageways and an air receiving end which is telescopically mounted to the base member. The base and air diffusing members are slidably engaged with one another between an extended position for use in the hair drying process and a collapsed position which permits convenient storage and reduced packaging size.

The air diffuser of the present invention may also include one or more intermediate connecting members located between the base and air diffusing members, each of the intermediate members being slidably engaged with one or more adjacent members to provide the ability to more fully extend or completely collapse the air diffuser.

BRIEF DESCRIPTION OF THE DRAWINGS

The novel features which are believed to be characteristic of the present invention are set forth in the appended claims. The invention itself, however, together with further objects and attendant advantages will be best understood by reference to the following description taken in connection with the accompanying drawings, in which:

DETAILED DESCRIPTION OF THE PREFERRED EMBODIMENT

Figure 1:
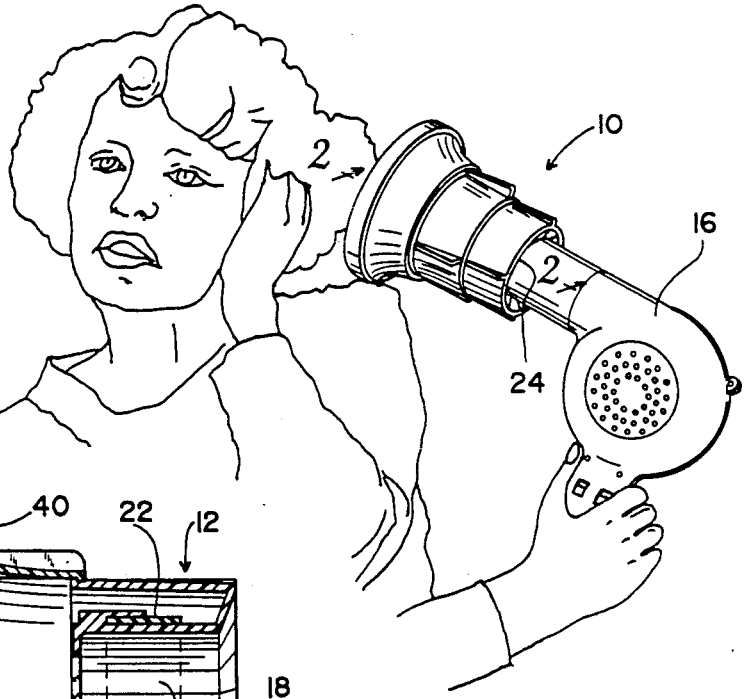
FIG. 1 is a perspective view illustrating the air diffuser apparatus of the present invention as mounted to a conventional hand-held hair drying apparatus.

With reference now to the drawings, the air diffuser of the present invention is designated generally as 10 and is shown to include a base member 12 and an air diffuser member 14. The base member 12 is provided with means for mounting the diffuser to the discharge port of a conventional hair drying apparatus. The mounting means of the preferred embodiment is a cylindrical collar 18 constructed from a plurality of resilient fingers 20 which are urged toward the axial center line of the diffuser by an annular biasing ring 22. The collar 18 is sized to slide onto the discharge port 24 of the hair dryer 16 in press fit relation.

Figure 5:
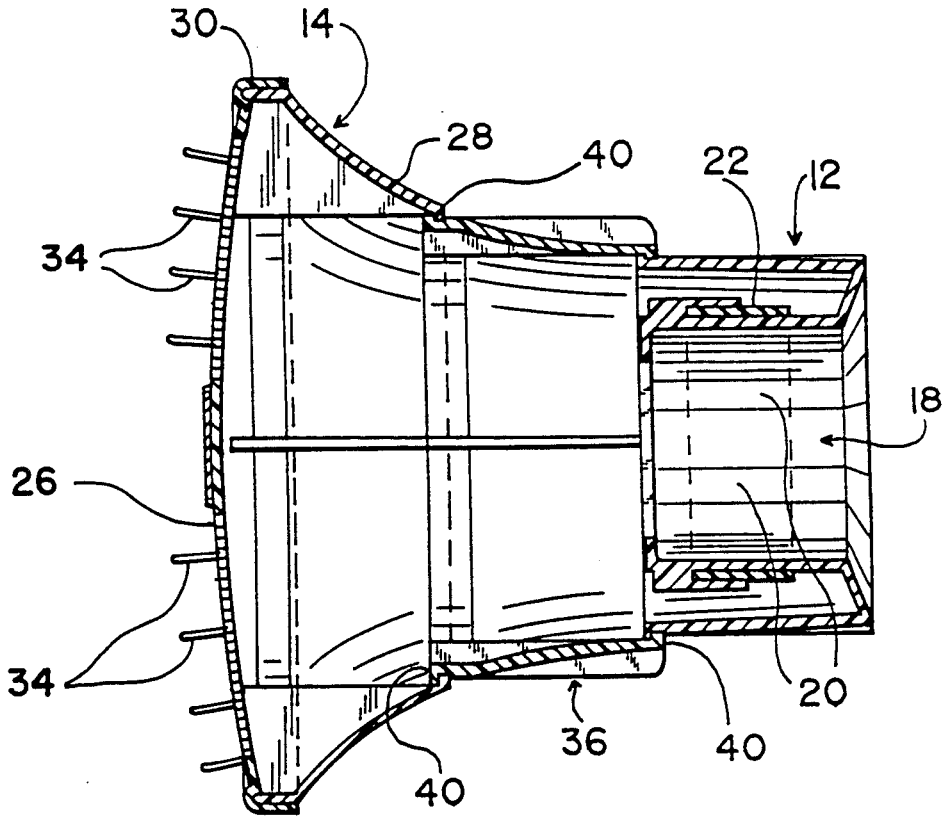
FIG. 5 is a cross-sectional view similar to that of FIG. 2 but showing an alternative and cap design.

The air diffusing member 14 includes an air discharge end 26 and an air receiving end 28. The air discharge end may most conveniently take the form of a cover or cap 30 provided with a plurality if air passageways 32 which allow the heated air received from the hair dryer 16 to be distributed over a wide area to enhance the hair drying characteristics of the entire assembly. Most preferably, the cover or cap 30 is removable to permit use of a variety of different cover configurations. One alternative configuration is illustrated in FIG. 5 and includes a plurality of protuberances 34 extending beyond the surface of the cover 30 and which may be used to comb or brush or otherwise enhance the hair styling characteristics of the device.

Figure 2:
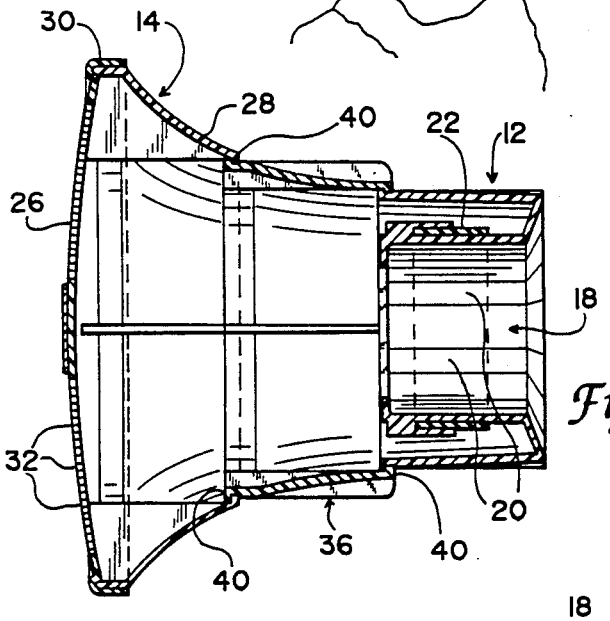
FIG. 2 is a longitudinal cross-sectional view taken along line 2—2 of FIG. 1, and showing the air diffuser in the fully extended operating position.
Figure 3:
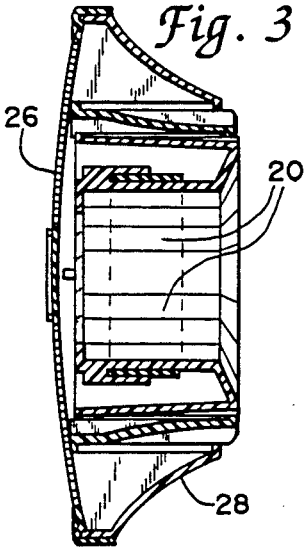
FIG. 3 is also a longitudinal cross-sectional view similar to that of FIG. 2 but showing the air diffuser of the present invention in the collapsed position.
Figure 4:
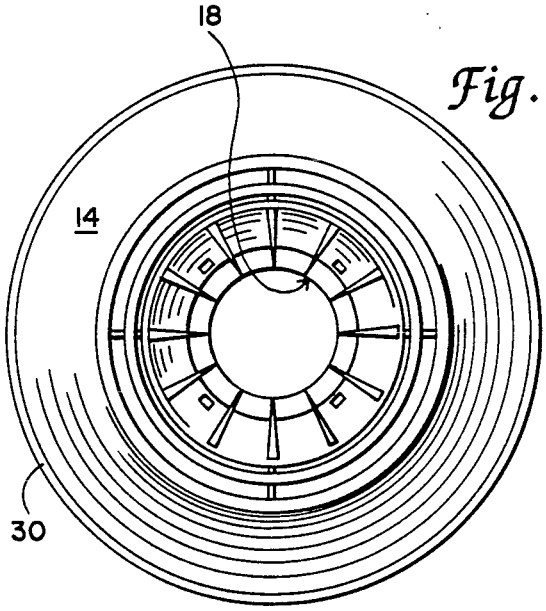
FIG. 4 is an end view of the air diffuser of the present invention illustrating details of the means for mounting the air diffuser to a conventional hair drying device.

As is clearly shown in FIGS. 2 and 3, the preferred form of the present invention also includes an intermediate connecting member 36 which is located between the base member 12 and air diffusing member 14. Of course, additional intermediate connecting members may be employed if desired to increase the extendibility and collapsibility of the diffuser. As is readily apparent from FIGS. 2 and 3, the base member 12, interconnecting member 36 and air diffusing member 14 are telescopically and slidably engaged so as to permit the extension of the air diffuser to a fully opened and operating position shown in FIG. 2 and the collapse of the diffuser for storage or shipment as illustrated in FIG. 3.

The air diffuser of the present invention may be constructed from any one of a wide variety of materials well known to those of skill in the art. Most preferably, the air diffuser is constructed of injection molded resilient plastic and each of the members 12, 36 and 14 are constructed with a tapered configuration such that when fully extended, the respective members are disposed in a press fit and generally rigid arrangement. In addition, each of the members may be provided with an outwardly extending lip 40 which will prevent the overlying member from being fully disassembled from its associated member. In preferred form, the axial length of collar 18 is equal to or less than the axial length of each of the members 12, 36 and 14 to thereby permit full collapse of the air diffuser.

Of course, it should be understood that various modifications may be made to the preferred embodiments disclosed herein without departing from the spirit and scope of the present invention. It is, therefore, intended that such modifications and changes be covered by the following claims.

I claim:

1. A portable air diffuser for use with a hand-held hair drying apparatus, said diffuser comprising:

a base member having means for mounting said diffuser to the discharge port of said drying apparatus;

an air diffusing member having an air discharge end provided with a plurality of air passageways and an air receiving end telescopically mounted over said base member;

said base and air diffusing members being slidably engageable between an extended operating position and a collapsed position wherein said base member is nested within said air diffusing member; and said mounting means adapted to engage the discharge port of said drying apparatus in press fit relation and having an axial length equal to or less than the axial length of said base and air diffusing members.

2. The air diffuser of claim 1 further including means associated with both said base and air diffusing members to prevent their complete disassembly.

3. The air diffuser of claim 1 further including an intermediate connecting member located between said base and air diffusing members, each of said members being slidably engaged with one or more adjacent members between said extended and collapsed positions.

4. An air diffuser for use with a hand-held hair drying apparatus, said diffuser comprising:

a base member having means for mounting said diffuser to the discharge port of said drying apparatus;

an air diffusing member having an air discharge end provided with a plurality of air passageways and an air receiving end telescopically mounted to said base member;

said base and air diffusing members being slidably engaged between an extended position and a collapsed position; and said air diffusing member further including hair managing protuberances mounted to a removable cap adapted to cover the air discharge end of said air diffusing member.

* * * * *